US007732725B2

(12) United States Patent
Takagi et al.

(10) Patent No.: US 7,732,725 B2
(45) Date of Patent: Jun. 8, 2010

(54) METHOD AND APPARATUS OF CLASSIFYING FINE PARTICLES

(75) Inventors: Seiichi Takagi, Kanagawa (JP); Okimasa Okada, Kanagawa (JP); Tetsuo Ohta, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 258 days.

(21) Appl. No.: 11/356,395

(22) Filed: Feb. 17, 2006

(65) Prior Publication Data

US 2007/0119754 A1 May 31, 2007

(30) Foreign Application Priority Data

Nov. 25, 2005 (JP) ..... 2005-339574

(51) Int. Cl.
*B03C 7/00* (2006.01)

(52) U.S. Cl. ..... 209/131; 209/12.2; 209/18; 209/155; 209/156; 209/172; 209/172.5; 209/173

(58) Field of Classification Search ..... 209/12.2, 209/18, 131, 155, 156, 172, 172.5, 173
See application file for complete search history.

(56) References Cited

U.S. PATENT DOCUMENTS 4,424,065 A * 1/1984 Langhoff et al. ..... 48/197 R
5,875,899 A * 3/1999 Nishiyama ..... 209/156
5,938,833 A * 8/1999 Willis et al. ..... 106/487
5,971,158 A * 10/1999 Yager et al. ..... 209/155
6,454,945 B1 * 9/2002 Weigl et al. ..... 210/634
7,328,807 B2 * 2/2008 Takagi et al. ..... 209/172.5
2003/0213729 A1 * 11/2003 Stencel et al. ..... 209/129
2006/0070921 A1 * 4/2006 Takagi et al. ..... 209/208

OTHER PUBLICATIONS

"Development of Method of Continuous Classification of Fine Particles Using Laminar Flow System in Microchannel." Proceedings of 69th Annual Meeting of the Society of Chemical Engineers, Japan, No. 201.

"Study on Behavior in Micro-Separator/Classifier by Euler-Lagrange Method." Proceedings of 69th Annual Meeting of the Society of Chemical Engineers, Japan, No. 202.

* cited by examiner

*Primary Examiner*—Patrick Mackey
*Assistant Examiner*—Kalyanavenkateshware Kumar
(74) *Attorney, Agent, or Firm*—Oliff & Berridge, PLC

(57) ABSTRACT

A method of classifying fine particles includes: introducing a fine particle dispersion containing the fine particles to a micro flow channel having an inlet part and a collection part from the inlet part; moving the fine particles to an inner upper side of the micro flow channel by an electric field applied in a gravitational direction; and delivering the fine particle dispersion in a laminar flow state to the collection part. The delivering step includes classifying the fine particles according to differences in settling velocity among the fine particles.

13 Claims, 3 Drawing Sheets

METHOD AND APPARATUS OF CLASSIFYING FINE PARTICLES

BACKGROUND OF THE INVENTION

1. Field of the Invention

The present invention relates to a method of classifying fine particles and, more particularly, to a method of classifying fine particles contained in fine particle dispersion by using a micro flow channel. Also, the present invention relates to an apparatus of classifying fine particles and, more particularly, to an apparatus of classifying fine particles contained in fine particle dispersion by using a micro flow channel.

2. Description of the Related Art

Methods of classifying fine particles include a dry classification method and a wet classification method.

The dry classification method may have high precision due to a large difference in specific gravity between the liquid and the fine particle.

On the other hand, according to the wet classification method, the difference in specific gravity between the liquid and the fine particle is small. However, the fine particles are easily dispersed in the liquid. Thus, high classification accuracy is obtained, especially, in a fine particle-size region. In both the dry classification method and the wet classification method, usually, a classifier has a rotary part. Further, it is a main stream approach to classify fine particles by utilizing the balance between a centrifugal force and an inertia force. However, due to the presence of the rotary part, related classifiers have problems of wear contaminants and cleaning thereof. A classifier for the dry classification method, which utilizes "Coanda effect" without a rotary part, has been commercialized. However, no classifier enabled to efficiently perform the wet classification method without a rotary part has been obtained.

Meanwhile, various methods of performing chemical reactions and unit operations in a micro-region have recently been studied. Methods and apparatuses of efficiently classifying fine particles without producing contaminants have been studied.

"Development of Method of Continuous Classification of Fine Particles Using Laminar Flow System in Microchannel", Proceedings of 69th Annual Meeting of the Society of Chemical Engineers, Japan, No. 201 has proposed a method and an apparatus of using a microchannel having a partly thinned part (a pinched channel) and utilizing the profile of a characteristic flow in the microchannel, so that fine particles in a direction perpendicular to the flow can be classified only by introducing the fine particles, as a method and an apparatus of classifying fine particles. This document has reported that this method can classify fine particles having diameters of 15 μm and 30 μm.

"Study on Behavior in Micro-Separator/Classifier by Euler-Lagrange Method", Proceedings of 69th Annual Meeting of the Society of Chemical Engineers, Japan, No. 202 has reported a method of separating and classifying fine particles by utilizing the difference in specific gravity between a fluid and a fine particle and also utilizing a centrifugal force and a lift force, which relate to the flow rate of the fluid, in a circular-arc-like microchannel that is rectangular in cross-section.

However, the former method, which classifies fine particles without utilizing a force of gravity and a centrifugal force, has problems of the settling and the sedimentation of fine particles onto the bottom surface of the channel in a case where the specific gravity of the fine particles is larger than that of a fluid. On the other hand, the latter method utilizes a centrifugal force and has good performance of classification in a case where the difference in specific gravity between the fine particle and the fluid. However, the settling of the fine particles is also facilitated. Thus, it is difficult to achieve both of the enhancement of classification efficiency and the prevention of the sedimentation of the fine particles and the blocking-up of the channel.

Both of the former method and the latter method have a problem that an amount of sediment increases and the flow channel is blocked up in a case where the classification is continuously performed for a long time.

SUMMARY OF THE INVENTION

This invention has been made in view of the above circumstances and provides method and apparatus of classifying fine particles. That is, an advantage of some aspects of the present invention is to provide a method and an apparatus of classifying fine particles, which can be used for a long time, without causing fine particles to clog and block up a flow channel. Also, another advantage of some aspect of the invention is to provide a method and an apparatus of classifying fine particles, which do not produce contaminants, such as abrasive substances, and which excels in classification efficiency.

The invention may provide a method of classifying fine particles, including: introducing a fine particle dispersion containing the fine particles to a micro flow channel having an inlet part and a collection part from the inlet part; moving the fine particles to an inner upper side of the micro flow channel by an electric field applied in a gravitational direction; and delivering the fine particle dispersion in a laminar flow state to the collection part; wherein the delivering step includes classifying the fine particles according to differences in settling velocity among the fine particles.

According to another aspect of the invention, the fine particles are selected from the group consisting of resin fine particles, inorganic fine particles, metal fine particles and ceramic fine particles.

According to another aspect of the invention, a volume-average diameter of the fine particles is ranged from 0.1 μm to 1000 μm.

According to another aspect of the invention, a rate of content of the fine particles in the fine-particle dispersion is ranged from 0.1-40% by volume.

According to another aspect of the invention, the classifying step includes applying a second electric field that increases differences in settling velocity among the fine particles according to sizes of the fine particles.

According to another aspect of the invention, an absolute value of ζ potential of the fine particles ranges from 1 mV to 1,000 mV.

According to another aspect of the invention, a magnitude of the electric field applied in a gravitational direction applied to the electrodes ranges from 0.1V to 5V.

According to another aspect of the invention, a magnitude of the electric field that increases the differences in the settling velocity among the fine particles ranges from 0.1V to 5V.

The invention may provide an apparatus of classifying fine particles dispersed in a medium liquid in a fine-particle dispersion, including: an introducing part including an introducing channel that introduces the fine-particle dispersion; an electric field applying part that applies an electric field; a classification part that classifies the fine particles by settling or floating the fine particles in a laminar flow; and a collection part including a collection channel from which classified fine particles are collected.

According to another aspect of the invention, the collection channel includes a plurality of collection channels.

According to another aspect of the invention, the plurality of collection channels are respectively disposed at different heights in a gravitational direction.

According to another aspect of the invention, the classification part includes a second electric field applying part.

According to another aspect of the invention, the introducing channel and the collection channel are disposed at 0 to 45° to a gravitational direction.

The invention can provide a method and an apparatus of classifying fine particles, which are-used for a long time, without causing fine particles to clog and block up a flow channel. Also, the invention can provide a method and an apparatus of classifying fine particles, which do not produce contaminants, such as abrasive substances, and which excels in classification efficiency.

BRIEF DESCRIPTION OF THE DRAWINGS

Preferred embodiment(s) of the present invention will be described in detail based on the following figures, wherein.

DETAILED DESCRIPTION OF THE INVENTION

Figure 1:
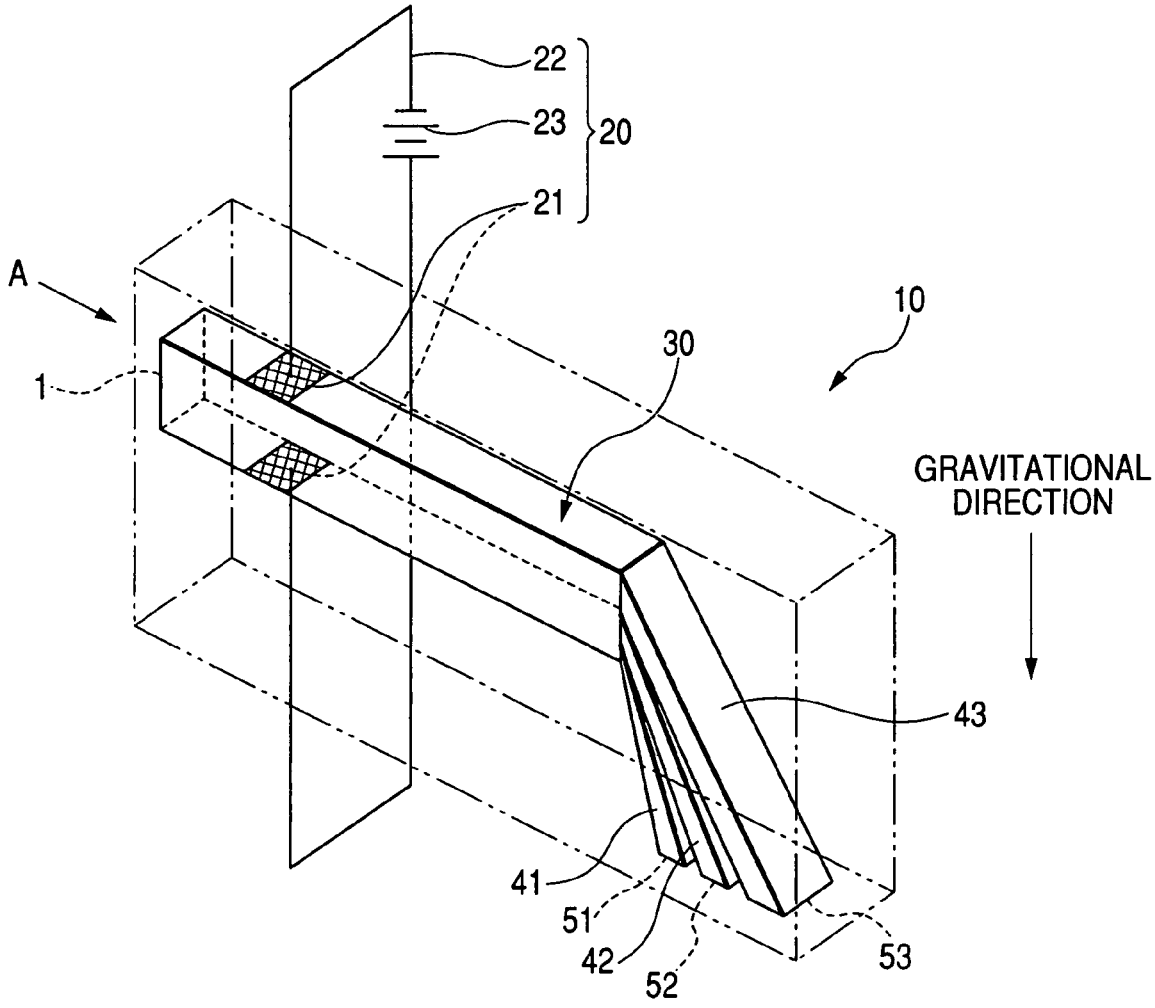
FIG. 1 is a schematic view illustrating the configuration of an example of a fine particle classifier that can be used in a method according to the invention.

The method of classifying fine particles according to the invention (hereunder, the "method of classifying fine particles" is also referred to simply as the "classification method") is a method of classifying fine particles contained in fine-particle dispersion by using a micro flow channel. This method features that this method includes the following steps in the following order. That is, this method includes a liquid delivering step of delivering fine particle dispersion in a laminar flow state from an inlet part of the micro flow channel, an electric field applying step of moving fine particles to an inner top surface of the micro flow channel by an electric field applied in a gravitational direction, and a classification step of classifying the fine particles according to differences in settling velocity among the fine particles.

Preferably, the classification method according to the invention further includes a collection step of collecting classified fine particles.

The invention utilizes the facts that the fluid in the microchannel is a laminar flow, and that in a case where fine particle dispersion is delivered, the settling velocity of the fine particles having the same density is proportional to the square of the particle diameter thereof, so that the larger the particle diameter of the fine particles, the higher the settling velocity thereof. It is important in the classification method utilizing the difference in settling velocity among fine particles that the fine particle dispersion is stably introduced into a laminar flow region.

The invention provides a classification method and a classification apparatus, which control fine particles by focusing attention on the polarities of the fine particles, and which stably classifies the fine particles with good precision. That is, upper and lower electrodes (corresponding to the electric field applying part) arranged in a gravitational direction are provided in a part of a flow channel disposed to intersect with the gravitational direction (that is, substantially horizontally disposed). An electric field is applied according to the polarity of the fine particles. Such application of the electric field enables the movement of the fine particles to the inner top surface of the flow channel. In a case where a classification part is provided in a downstream region of the electric field applying part, the fine particles can be settled from the position of the classification part. Consequently, the fine particles can be classified with good accuracy.

The classification method according to the invention uses a micro flow channel. Preferably, a microreactor having a flow channel, whose width ranges from several μm to several thousands μm, is used. A microreactor used in the classification method according to the invention is a reactor having a plurality of micrometer-scaled flow paths (channels). The channels of the microreactor are micrometer-scaled, so that the size and the flow rate of fluid in the channels are small. The Raynolds number of a fluid in the channel is equal to or less than 2300. Therefore, the reactor having the micrometer-scaled channels is not an ordinary reactor, in which the flow of fluid is dominated by a turbulent flow, but a reactor in which the flow is dominated by a laminar flow.

Incidentally, in the present specification, the term "microchannel" designates micrometer-scaled channels. However, the "microchannel" includes a millimeter-scaled channel. Also, the "microchannel" sometimes designates a device including such a channel. Also, such an apparatus may be generically referred to as a microreactor.

Incidentally, the Raynolds number (Re) is represented by the following equation:

$$Re=uL/\nu$$

where "u" designates a flow rate, "L" denotes a characteristic length, and "ν" designates a kinematic viscosity coefficient. In a case where the Raynolds number is equal to or less than 2300, the flow of fluid is dominated by a laminar flow.

As described above, in the case where the flow of fluid is dominated by a laminar flow and where the specific gravity of the fine particles contained in the fine particle dispersion is larger than that of the liquid serving as a dispersive medium, the fine particles settle in the liquid. The settling velocity at that time varies with the specific gravity or the particle diameter of the fine particles. The method of classifying fine particles according to the invention is to classify the fine particles by utilizing the difference in settling velocity among the fine particles. Especially, in the case where the particle diameters of the fine particles differ from one another, the settling velocity is proportional to the square of the particle diameter, so that the larger the particle diameter of a fine particle becomes, the fine particle rapidly settles. Thus, the classification method according to the invention is suitable for classifying fine particles differing in particle diameter from one another.

On the other hand, in a case where the diameter of the flow channel is large and where the flow of fine particle dispersion is a turbulent flow, the settling position of the fine particles changes. Thus, basically, the classification accuracy is degraded.

FIG. 1 shows the configuration of an example of a fine particle classifier that can be used in the method according to the invention.

The fine particle classifier according to the invention (hereunder, the "classifier of classifying fine particles" is also referred to simply as the "classifier") includes a fine particle dispersion inlet port 1 from which fine particle dispersion is introduced, an electric field applying part 20 adapted to apply an electric field, a classification part 30, and collection ports 51, 52, and 53 from which classified fine particles are collected. The electric field applying part 20 has upper and lower electric field applying electrodes 21 arranged in a gravitational direction in a microchannel. Also, the collection ports 51 to 53 are placed lower in the gravitational direction than the classification part 30.

Additionally, the fine particle classifier according to the invention may have a fluid inlet port from which fluid including no fine particles is introduced.

The fine particle classifier shown in FIG. 1 is a microreactor 10 having a flow channel, whose width ranges from several μm to several thousands μm. The microreactor 10 has the fine particle dispersion inlet port 1 from which fine particle dispersion A is introduced to the micro flow channel. Although the microreactor 10 may have only one fine particle dispersion inlet port, the microreactor 10 can have a plurality of fine particle dispersion inlet ports.

The fine particle dispersion A inputted from the fine particle dispersion inlet port 1 is introduced to the micro flow channel. The fine particle dispersion A introduced to the micro flow channel flows downstream in a laminar flow state through the electric field applying part 20 and the classification part 30.

Incidentally, in the present specification, the micro flow channel extending from the fine particle dispersion inlet port to the electric field applying part is referred to as an inlet flow channel.

The fine particle classifier according to the invention has the electric field applying part 20 adapted to apply an electric field to the fine particles contained in the introduced fine particle dispersion. The electric field applying part 20 has the upper and lower electric field applying electrodes 21 arranged in the gravitational direction in the micro flow channel. The upper and lower electric field applying electrodes 21 are connected to a power supply 23 through an energizing electric wire 22. Incidentally, in the present specification, the micro flow channel of the electric field applying part is referred to as an electric field applying flow channel.

Preferably, the value of the length of the electric field applying flow channel is appropriately selected to be sufficient to the extent that the fine particles move to the inner top surface of the flow channel.

In a case where the classifier has no electric field applying part, fine particles cannot stably be introduced to the classification part. Consequently, high classification accuracy cannot be obtained. The electric field applying part applies an electric field onto the fine particles, so that the fine particles can be moved once to the inner top surface of the flow channel. Consequently, fine particles are stably introduced from the inner top surface of the flow channel to the classification part placed downstream of the electric field applying part. Thus, the classification accuracy is enhanced.

Although the electric field applying electrodes are placed at upper and lower positions in the gravitational direction in the micro flow channel, the upper and lower positions in the gravitational direction can appropriately be selected in a range enabling the fine particles by the application of an electric field thereto to move to the inner top surface of the flow channel.

Also, although the shapes of the electrodes of the electric field applying part can appropriately be selected, preferably, plate-like electrodes are provided on the inner top surface and the inner bottom surface of the inner wall of the flow channel, which are arranged in the gravitational direction in the flow channel, in a case where the flow channel is substantially rectangular in cross-section. Additionally, in a case where the flow channel is substantially circular in cross-section, preferably, electrodes rounded to fit to the shape of the flow channel are placed at upper and lower positions arranged in the gravitational direction on the inner wall of the micro flow channel. Further, preferably, the two electrodes are provided across the micro flow channel. Also, the electrodes may be provided on the inner wall of the flow channel to be in contact with a fluid medium. Alternatively, the electrodes may be provided on the inner wall of the flow channel by being covered with an appropriate material not to be directly in contact with a fluid medium.

Preferably, the strength of an electric field applied to the electric field applying part is appropriately selected according to the characteristics of the fine particles. The orientation and the strength of the electric field are selected so that the fine particles are moved to the inner top surface of the flow channel.

Practically, in a case where an electric field is applied to negatively charged fine particles, the electric field to be applied is such that the polarity of the upper electrode is positive. Conversely, in a case where an electric field is applied to positively charged fine particles, the electric field to be applied is such that the polarity of the upper electrode is negative.

According to the invention, the magnitude of a voltage applied to the electrodes varies with the kind of the fine particle dispersion and preferably ranges from 0.5V to 10V, more preferably ranges from 1V to 5V. It is preferable that the magnitude of the voltage is within the aforementioned range, because of the facts that medium liquid, such as water, is not electrolyzed, and thus that air bubbles are not generated, and that the movement of the fine particles to the inner top surface of the flow channel is sufficiently achieved.

Preferably, all the parts of the flow channel, which are other than the inlet flow channel, the electric field applying part, and the classification part, are inclined to the gravitational direction by an angle ranging from 0 to 45°. More preferably, all the parts of the flow channel are inclined thereto by an angle ranging from 0 to 30°. Furthermore preferably, all the parts of the flow channel are inclined thereto by an angle ranging from 0 to 15°. Especially preferably, all the parts of the flow channel are inclined thereto by an angle ranging from 0 to 10°.

It is preferable that the flow channel is inclined to the gravitational direction by an angle ranging from 0 to 45°. This is because of the facts that the deposition and the sedimentation of fine particles on the inner wall surface of the flow channel due to the settling thereof do not occur, and that the blocking-up of the flow channel does not occur.

The fine particles moved to the inner top surface of the flow channel in the electric field applying part 20 are delivered together with the liquid in a laminar flow state to the classification part 30. The fine particle dispersion A introduced to the classification part flows downstream in a laminar flow state in the classification part 30. The fine particles are settled in a laminar flow state in the classification part 30 to thereby classify the fine particles. During the fine particle dispersion flows downstream through the classification part, the fine particles contained in the fine particle dispersion gradually settle down, because the specific gravity of the fine particles is larger than that of the medium liquid in the fine particle dispersion.

At that time, the settling velocity of the fine particles varies with the density or the particle diameter thereof. Thus, when the fine particles reach the downstream end of the classification part, the fine particles distribute at different heights in the gravitational direction. Consequently, the fine particles flow into the collection passages 41 to 43 respectively disposed at different heights in the gravitational direction. Thus, the classified fine particles can be obtained from the collection ports 51 to 53, respectively.

In the classifier shown in FIG. 1, relatively larger fine particles are collected from the collection port 51. Relatively smaller fine particles are collected from the collection port 53.

Incidentally, in the present specification, the micro flow channel of the classification part is referred to also as the classification flow channel.

Preferably, in the classifier according to the invention, the inlet flow channels, the electric field applying part and the classification part are substantially horizontally installed. Preferably, an angle formed between the horizontal direction and each of these elements ranges from 0 to 45°. More preferably, the angle formed between the horizontal direction and each of these elements ranges from 0 to 30°. Furthermore preferably, the angle formed between the horizontal direction and each of these elements ranges from 0 to 15°.

Preferably, the classifier according to the invention has a plurality of collection passages. More preferably, the collection passages are connected to the classification part at different positions in the gravitational direction, or in the direction of the flow of fine particle dispersion (or the liquid mixture of the fine particle dispersion and the fluid). Furthermore preferably, the collection passages are connected to the classification part at different positions in both of the gravitational direction and the direction of the flow of fine particle dispersion (or the liquid mixture of the fine particle dispersion and the fluid).

In a case where the flow channel has a wall surface part in which the diameter or the shape of the flow channel changes, preferably, the wall surface part is inclined to the gravitational direction by an angle ranging from 0 to 45°. More preferably, the wall surface part is inclined to the gravitational direction by an angle ranging from 0 to 30°. Furthermore preferably, the wall surface part is inclined to the gravitational direction by an angle ranging from 0 to 15°. Especially preferably, the wall surface part is inclined to the gravitational direction by an angle ranging from 0 to 10°.

It is preferable that the wall surface part is inclined to the gravitational direction by an angle which is within the aforementioned range. This is because of the facts that the fine particles do not settle down even when the flow rate is low, that the deposition and the sedimentation of fine particles on the inner wall surface of the flow channel due to the settling thereof do not occur, and that the blocking-up of the flow channel does not occur.

Incidentally, in a case where the shape of the flow channel varies with parts of the flow channel, an angle with respect to the gravitational direction is an angle formed between the centerline of each of the flow channels and the gravitational direction.

Additionally, in the fine particle classifier shown in FIG. 1, the shape of the cross-section of each of the fine particle dispersion inlet flow channel, the flow channels of the electric field applying part and the classification part, and the collection passages is a rectangle. However, the shape of the cross-section thereof is not limited thereto and may be any other shape, for example, an ellipse, a circle, and a substantially rectangle whose corners are rounded.

Figure 2:
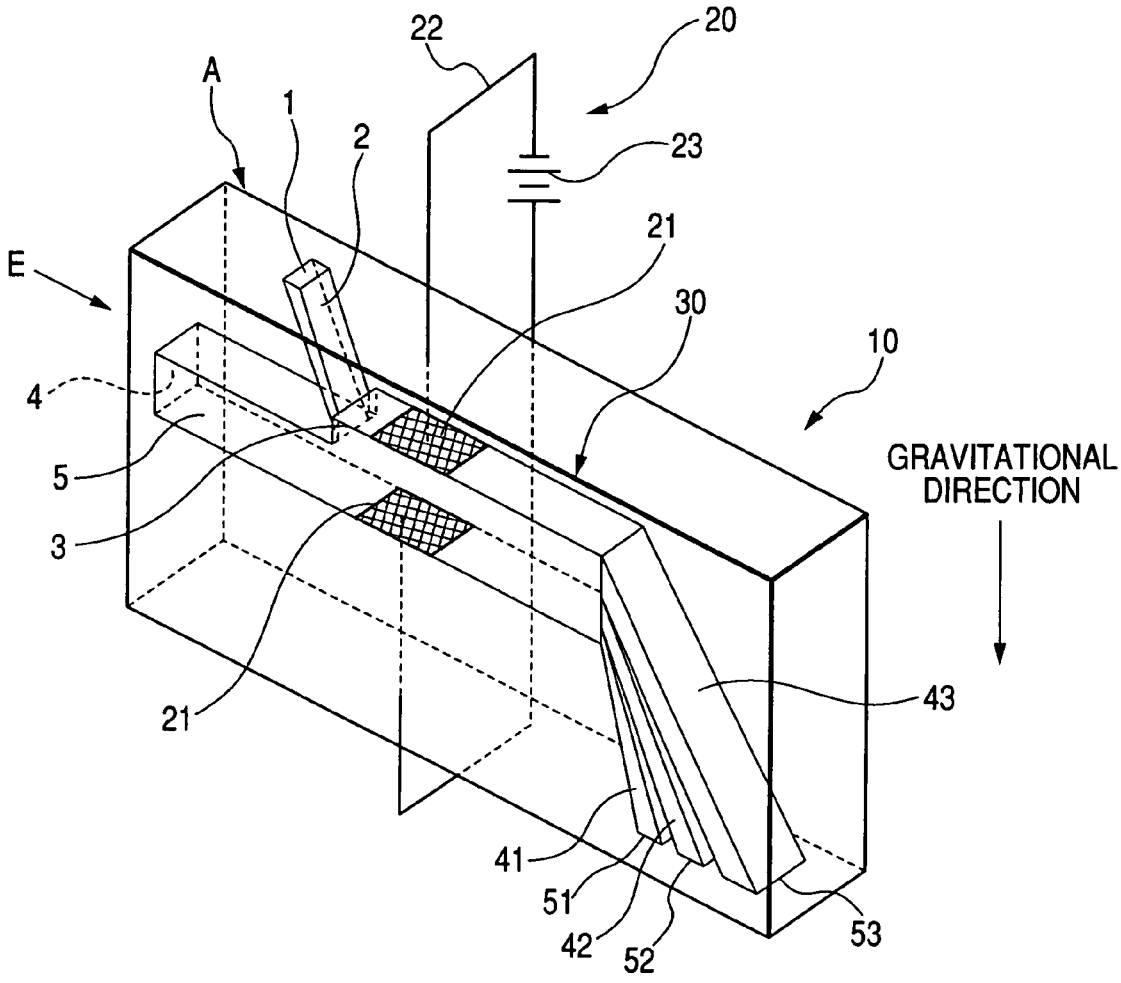
FIG. 2 is a schematic view illustrating the configuration of another example of a fine particle classifier that can be used in a method according to the invention.

Also, a microreactor having a fluid inlet port 4 in addition to the fine particle dispersion inlet port as shown in FIG. 2 can be used in the method according to the invention.

Fine particle dispersion A introduced from the fine particle dispersion inlet port 1 flows through the fine particle dispersion inlet passage 2 and is led to a micro flow channel from a communicating part 3. On the other hand, a fluid E is introduced from the fluid inlet port 4. The introduced fluid E flows through a fluid inlet passage 5 and is led to the micro flow channel. The fine particle dispersion A and the fluid E led to the micro flow channel flow downstream in a laminar flow state through the electric field applying part 20 and the classification part 30.

In the fine particle classifier shown in FIG. 2, the fine particle dispersion inlet port 1 is placed upper in the gravitational direction than the electric field applying part and the classification part. However, the fine particle dispersion can be introduced from any position in this direction. According to the invention, the fine particles can be moved by the aforementioned electric field applying part to the inner top surface of the flow channel and can stably be delivered to the classification part. Thus, as long as the fine particle dispersion can be introduced, the fine particles may be introduced in any other manner.

In the classifiers shown in FIGS. 1 and 2, preferably, the introduction of the fine particle dispersion A to the fine particle dispersion inlet port 1 and that of the fluid E to the fluid inlet port 4 are performed by press-fitting the liquid and the fluid through the use of a micro syringe, a rotary pump, a screw pump, a centrifugal pump, and a piezo pump.

In the fine particle classifier shown in FIG. 1, preferably, the flow rate of the fine particle dispersion A ranges from 0.002 ml/hr to 1,000 ml/hr. More preferably, the flow rate of the fine particle dispersion A ranges from 0.1 ml/hr to 500 ml/hr.

In the fine particle classifier shown in FIG. 2, preferably, the flow rate of the fine particle dispersion A in the fine particle dispersion inlet passage 2 ranges from 0.001 ml/hr to 100 ml/hr. More preferably, the flow rate of the fine particle dispersion A therein ranges from 0.01 ml/hr to 500 ml/hr.

Also, preferably, the flow rate of the fluid E in the fluid inlet passage 5 ranges from 0.002 ml/hr to 1,000 ml/hr. More preferably, the flow rate of the fluid E herein ranges from 0.01 ml/hr to 500 ml/hr.

Relatively insulating materials commonly used, such as ceramics, plastics, and glass, are available as the material of the microreactor used in the classifier according to the invention. Preferably, the material of the microreactor is appropriately selected according to the medium liquid to be delivered.

The classifier having the electric field applying part according to the invention can be obtained by adding the electrodes thereto through vapor deposition or plating after the microreactor having no electrodes is manufactured by an ordinarily known method. However, the electrodes can be manufactured by being embedded in the wall surface of the flow channel.

The fine particle dispersion A used in the method according to the invention is described below.

Preferably, the fine particle dispersion A is such that fine particles, the volume mean diameter of which ranges from 0.01 μm to 1,000 μm, are dispersed in the medium liquid, and that the difference in specific gravity between the fine particle and the medium liquid ranges from 0.01 to 20.

The fine particles contained in the fine particle dispersion used in the method according to the invention can favorably be used, as long as the fine particles are moved by applying an electric field thereto. Incidentally, the fine particles moved by applying an electric field thereto are those having zeta potential.

The zeta potential of the fine particle moved by applying an electric field thereto can be measured by an ordinary device capable of measuring zeta potential. In the case of the method according to the invention, the zeta potential was measured by using a spectrometer DT1200 (manufactured by Dispersion Technology Inc.). Preferably, the absolute value of the zeta potential of the fine particles contained in the dispersion ranges from 1 mV to 1,000 mV. More preferably from a viewpoint of productivity, the absolute value of the zeta potential thereof ranges from 30 mV to 300 mV.

Preferably, the volume mean diameter of the fine particles ranges from 0.1 μm to 1,000 μm. More preferably, the volume mean diameter of the fine particles ranges from 0.1 μm to 500 μm. Furthermore preferably, the volume mean diameter of the fine particles ranges from 0.1 μm to 200 μm. It is preferable that the volume mean diameter of the fine particles is within the aforementioned range, because of the facts that the fine particles are stably moved by an electric field, and that the blocking-up of the flow channel does not occur.

The shape of the fine particles used in the method according to the invention is not particularly limited. However, in a case where the fine particles are shaped like a needle, especially, in a case where the length of the major axis thereof becomes larger than ¼ of the width of the flow channel, the possibility of occurrence of the clogging of the channel becomes high. From this viewpoint, it is preferable that the ratio of the length of the major axis of the fine particle to that of the minor axis thereof (that is, the major axis length/the minor axis length) ranges from 1 to 50. More preferably, this ratio ranges from 1 to 20. Incidentally, preferably, the channel width is appropriately selected according to the particle diameter and the particle shape of the fine particles.

The fine particles used in the method according to the invention have a positive polarity or a negative polarity in the medium liquid. For example, in a water medium, the fine particles have the negative polarity in a case where a molecular end, such as —COOH, —CN, or —$SO_2$, is present on the surface of each of the fine particles. On the other hand, the fine particles have the positive polarity in a case where a molecular end, such as —$NH_3$, or —$NH_4^+$, is present on the surface of each of the fine particles.

Examples of the fine particles having the negative polarity in the medium liquid, which serve as anionic polymers, are polymers of the following anionic polymeric monomers, which are the following monomers containing a hydroxyl group, a carboxyl group, a sulfonic group, a phosphoric group, and acid anhydride, that is, 2-acrylamide-2-methylpropane sulfonic acid, N-methylol acrylamide, methacrylic acid, acrylic acid, methacrylic acid-2-hydroxyethyl, methacrylic acid-2-hydroxypropyl, methacrylic acid glycidyl, polypropylene glycol monomethacrylate, polyethylene glycol monomethacrylate, methacrylic acid tetrahydrofurfuryl, acid phosphooxy ethyl methacrylate, and maleic anhydride. Also, other examples of such fine particles are copolymers of these monomers and one or more kinds of the following monomers. That is, one kind of the following monomers, such as styrenes, for example, styrene, o-methylstyrene, p-methylstyrene, 2,4-dimethylstyrene, p-n-butylstyrene, p-tert-butylstyrene, p-n-dodecylstyrene, p-chlorstyrene, and p-phenylstyrene; vinylnaphthalenes; ethylene unsaturated monoolefin, such as ethylene, propylene, and isobutylene; vinyl esters, such as vinyl chloride, vinyl acetate, vinyl butyrate, and vinyl benzoate; α-methylene aliphatic monocarboxylic acid esters, such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; acrylic acid and methacrylic acid derivatives such as acrylonitrile, methacrylonitrile and acrylamide; vinyl ethers, such as vinylmethyl ether, vinylethyl ether and vinylisobutyl ether; vinyl ketones, such as vinylmethyl ketone, vinylhexyl ketone and methylisopropenyl ketone; and N-vinyl compounds, such as N-vinylpyrrole, N-vinylcarbazole, N-vinylindole and N-vinylpyrrolidine. Alternatively, two or more kinds of these monomers may be used as those constituting the copolymers. Alternatively, one kind or more kinds of these monomers may be contained in the polymeric monomer. Among these polymers and copolymers, a copolymer or a blend of polyacrylic acid and polyacrylonitrile is preferable.

On the other hand., examples of the fine particles having the negative polarity in the medium liquid, which serve as cationic polymers, are polymers of the following cationic polymeric monomers, that is, nitrogen-containing monomers, such as dimethylaminoethyl methacrylate, dimethylaminoethyl acrylate, diethylaminoethyl methacrylate, diethylaminoethyl acrylate, N-n-butoxyacrylamide, trimethylammonium chloride, diacetone acrylamide, acrylamide, N-vinylcarbazole, vinylpyridine, 2-vinylimidazole, 2-hydroxy-3methacryloxypropyl trimethylammonium chloride, 2-hydroxy-3-acryloxypropyl trimethylammonium chloride, or polymers of these monomers obtained by quaternizing nitrogen atoms therein. Other examples of the fine particles having the negative polarity in the medium liquid, which serve as cationic polymers, are copolymers of these nitrogen-containing monomers and one kind or more kinds of the following monomers, that is, styrenes, such as styrene, o-methylstyrene, m-methylstyrene, p-methylstyrene, p-methoxystyrene, p-phenylstyrene, p-chlorstyrene, 3,4-dichlorstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene; or, for example, ethylene unsaturated monoolefins, such as ethylene, propylene, butylene and isobutylene; vinyl halides, such as vinyl chloride, vinylidene chloride, vinyl bromide and vinyl fluoride; vinyl esters, such as vinyl acetate, vinyl propionate, vinyl benzoate and vinyl butyrate; α-methylene aliphatic monocarboxylic acid esters, such as methyl methacrylate, ethyl methacrylate, propyl methacrylate, n-butyl methacrylate, isobutylmethacrylate, n-octylmethacrylate, dodecylmethacrylate, 2-ethylhexyl-methacrylate, stearyl methacrylate, phenyl methacrylate, dimethylaminoethylmethacrylate, diethylaminoethyl methacrylate, methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chlorethyl acrylate, phenyl acrylate, and α-methyl chloracrylate; vinyl ethers, such as vinyl methylether, vinyl ethylether and vinyl isobutylether; vinyl ketones, such as vinyl methyl ketone, vinyl hexyl ketone and methyl isopropenyl ketone; N-vinyl compounds such as N-vinyl pyrrole, N-vinyl carbazole, N-vinyl indole and N-vinyl pyrolidone; vinyl naphthalenes; and acrylic acid such as acrylonitrile, methacrylonitrile and acrylamide, or methacrylic acid derivatives. Among these polymers, a copolymer of poly-dimethylaminoethyl methacrylate or a blend including poly-dimethylaminoethyl methacrylate is preferable.

Among fine particles used in the method according to the invention, inorganic fine particles made of metal oxide, such as $SiO_2$and $TiO_2$, have the negative polarity. Those made of, for example, aluminum oxide have the positive polarity. It is known that fine particles treated with silane coupling agents have the positive or negative polarity according to kinds and proportions of terminal groups that the coupling agents have.

For example, in a case where $SiO_2$ is treated with a silane coupling agent including an amino group, the fine particles made of $SiO_2$ have the positive polarity.

The polarity of the fine particle used in the method according to the invention depends upon not only the chemical properties of the surface thereof but the species of dissolved ions contained in the medium or the kind of a surface acting agent and can basically be controlled.

Various processes of producing these fine particles may be used. In most cases, fine particles are produced by synthesis in the medium liquid, and are then classified without being modified. Fine particles may be produced by crushing a lump mechanically, and by being then dispersed in the medium liquid. In this case, it is frequent to crush the lump in the medium liquid. Also, in this case, the produced fine particles are classified without being modified.

On the other hand, in a case where powder or fine particles produced by a dry method, it is necessary to preliminarily disperse the fine particles in the medium liquid. Examples of a method of dispersing the dry powder in the medium liquid are methods respectively using a sand mill, a colloid mill, an Atritor (manufactured by Mitsui Miike Kabushiki kaisha), a ball mill, a DYNO mill (manufactured by Shinmaru Enterprises Corporation), a high-pressure homogenizer, an ultrasonic disperser, a Co-ball mill (manufactured by ITOCHU FOODEC CORPORATION), and a roll mill. At this time, it is preferable that the method is performed under conditions in which primary particles are not pulverized by dispersion.

According to the invention, preferably, the difference obtained by subtracting the specific gravity of the medium liquid from that of the fine particle ranges from 0.01 to 20. More preferably, the difference obtained by subtracting the specific gravity of the medium liquid from that of the fine particle ranges from 0.05 to 11. Furthermore preferably, the difference obtained by subtracting the specific gravity of the medium liquid from that of the fine particle ranges from 0.05 to 4. In a case where the difference obtained by subtracting the specific gravity of the medium liquid from that of the fine particle is less than 0.01, sometimes, the fine particles are not settled. On the other hand, in a case where the difference obtained by subtracting the specific gravity of the medium liquid from that of the fine particle is more than 21, the fine particles are intensely settled, so that it is sometimes difficult to deliver the fine particles.

The medium liquid to be used in the method according to the invention can preferably be used, as long as the difference obtained by subtracting the specific gravity of the medium liquid from that of the fine particle ranges from 0.01 to 20. Examples such medium liquid are water, an aqueous medium, and an organic solvent type medium.

Meanwhile, although any medium liquid can basically be used, preferably, the electric conductivity of the medium liquid ranges from 0 to 50 μS/cm. More preferably, the electric conductivity of the medium liquid ranges from 0 to 20 μS/cm. Furthermore preferably, the electric conductivity of the medium liquid ranges from 0 to 10 μS/cm. In a case where the electric conductivity of the medium liquid exceeds 50 μS/cm, the movement of the fine particles is sometimes unstable in the electric field.

The medium liquid preferably used in the method according to the invention is, for example, water, or alcohol. Especially, an aqueous medium is preferable.

Ion-exchanged water, distilled water, electrolyticion water, and the like are cited as the aforementioned water. Also, concretely, methanol, ethanol, n-propanol, n-butanol, benzyl alcohol, methyl cellsolve, ethyl cellsolve, acetone, methyl ethyl ketone, cyclohexanone, methyl acetate, n-butyl acetate, dioxane, tetrahydrofuran, methylene chloride, chloroform, chlorobenzene, toluene, xylene, and mixtures of two or more kinds of these compounds are cited as the aforementioned organic solvent based media.

The combination of a polystyrene-acrylic ester copolymer fine particle, which has a carboxyl group on the surface thereof, or a polyester resin fine particle and an aqueous medium, and the combination of a polystyrene-acrylic ester copolymer fine particle, which has an amino group or a quanternized ammonium group, or a polyester resin fine particle and an aqueous medium are cited as the preferred combination of the fine particle and the medium liquid. Between these combinations, the former combination is more preferable.

Preferably, the content by percentage of the fine particles in the fine particle dispersion ranges from 0.1% to 60% by volume. More preferably, the content by percentage of the fine particles in the fine particle dispersion ranges from 5% to 25% by volume. In a case where the content by percentage of the fine particles in the fine particle dispersion is less than 0.1% by volume, the collection of the fine particles is sometimes problematic. In a case where the content by percentage is more than 40% by volume, the possibility of occurrence of clogging of the flow channel may increase.

Incidentally, the volume-average particle diameter of fine particles is a value measured by using a Coulter counter TA-II model (manufactured by Beckman Coulter, Inc.) except a case where the particle diameter of the fine particles have a particles is equal to or less than 5 μm. The volume-average particle diameter is measured by using an optimal aperture according to the particle diameter level of the fine particles. However, in the case where the particle diameter of the fine particles is equal to or less than 5 μm, the volume-average particle diameter is measured by using a laser scattering particle diameter distribution measuring device (LA-920 manufactured by Horiba Ltd.). Also, in a case where the particle diameter is of the order of nanometers, the volume-average particle diameter is measured by using a BET type specific surface area measuring device (Flow SurbII2300 manufactured by Shimadzu Corp.).

The specific gravity of fine particles is measured by a gas phase substitution method (a Pycnometer method) using Ultra-Pycnometer 1000 manufactured by Yuasa Ionics Co., Ltd.

Also, the specific gravity of any liquid medium is measured with a density determination kit AD-1653 manufactured by A & D Instrument Ltd.

In the classifier according to the invention, the fluid E is liquid containing no fine particles to be classified. According to the invention, preferably, the medium liquid and the fluid are the same liquid.

Also, in a case where the fluid E differs from the medium liquid, preferably, the fluid E is liquid of the same kind as that of a practical example of the medium liquid.

Also, a preferred ratio of the specific gravity of the fluid to that of the fine particles is similar to a preferred ratio of the specific gravity of the medium liquid to that of the fine particles.

A preferred embodiment of the fine particle classification method according to the invention includes a second electric field applying step of applying an electric field that increases the differences in settling velocity among the fine particles due to the sizes thereof. The second electric field applying step is preferable in a case where an electric field is applied to fine particles that move in a direction opposite to the gravitational direction.

The fine particles moved to an internal upper part of the flow channel are settled in the classification part by a force of gravity. At that time, the force of gravity is proportional to the cube of the particle diameter of the fine particles. On the other hand, the magnitude of energy provided to the surface charge of the fine particles by application of an electric field is proportional to the square of the particle diameter of the fine particles. Therefore, when an appropriate electric field is applied to fine particles, relatively heavy fine particles are settled in the gravitational direction because the magnitude of the force of gravity exerted thereon is larger than that of an electric force due to the electric field. Conversely, relatively light fine particles are floated up in the gravitational direction because the magnitude of an electric force due to the electric field is larger than that of the force of gravity exerted thereon.

Thus, the fine particles are stably introduced to the classification part from the inner top surface of the flow channel by performing the first electric field applying step. Subsequently, the relatively heavy fine particles are settled down and the relatively light fine particles are floated up by performing the second electric field applying step. Consequently, the fine particles can be classified with higher accuracy. Therefore, the second electric field applying step is preferable.

A second electric field applying part is provided in the classification part. Similarly to the first electric field applying part, upper and lower electrodes are respectively disposed at upper and lower positions in the gravitational direction with respect to the micro flow channel. The upper and lower positions in the gravitational direction can appropriately be selected in a range enabling the fine particles by the application of an electric field thereto to move to the inner top surface and the inner bottom surface of the flow channel. That is, it is especially preferable to apply an appropriate electric field to the fine particles so that a part of fine particles moves to the inner top surface in the flow channel, and that the other fine particles move to the inner bottom surface in the flow channel.

The second electric field applying part has the upper and lower electric field applying electrodes arranged in the gravitational direction in the micro flow channel. The upper and lower electric field applying electrodes are connected to a power supply through an energizing electric wire.

The shapes of the electrodes of the second electric field part can appropriately be selected. However, in a case where the shape of a cross-section of the flow channel is substantially rectangle, preferably, plate-like electrodes are provided to be arranged in the gravitational direction. Also, in a case where the shape of a cross-section of the flow channel is substantially circle, preferably, electrodes rounded to fit to the shape of the flow channel are placed at upper and lower positions arranged in the gravitational direction. Further, preferably, the two electrodes are provided across the micro flow channel.

Preferably, the strength of an electric field applied to the second electric field applying part is appropriately selected according to the characteristics of the fine particles. The orientation and the strength of the electric field are selected so that the relatively large-diameter fine particles are settled by the force of gravity, while the relatively small-diameter fine particles are moved to the inner top surface in the flow channel by the electric field.

Practically, in a case where an electric field is applied to negatively charged fine particles, the electric field, which is such that the polarity of the upper electrode is positive, is applied thereto. Conversely, in a case where an electric field is applied to positively charged fine particles, the electric field, which is such that the polarity of the upper electrode is negative, is applied thereto.

According to the invention, the magnitude of a voltage applied to the electrodes varies with the kind of the fine particle dispersion and preferably ranges from 0.1V to 5V, more preferably ranges from 0.5V to 3V. It is preferable that the magnitude of the voltage is within the aforementioned range, because of the facts that medium liquid, such as water, is not electrolyzed, and thus that air bubbles are not generated, and that the movement of the fine particles to the inner top surface of the flow channel is sufficiently achieved.

In the classification part, the second electric field applying part can be provided over the entire classification flow channel. However, preferably, the second electric field applying part is provided over a part of the classification flow channel. Preferably, the second electric field applying part has a length that ranges from 10% of the length of the entire classification flow channel to 90% thereof. More preferably, the second electric field applying part has a length that ranges from 10% of the length of the entire classification flow channel to 50% thereof.

Preferably, the second electric field applies an electric field to fine particles, the classification of which proceeds. Also, preferably, the second electric field applying part is provided at a latter half of the classification part.

EXAMPLE 1

Figure 3:
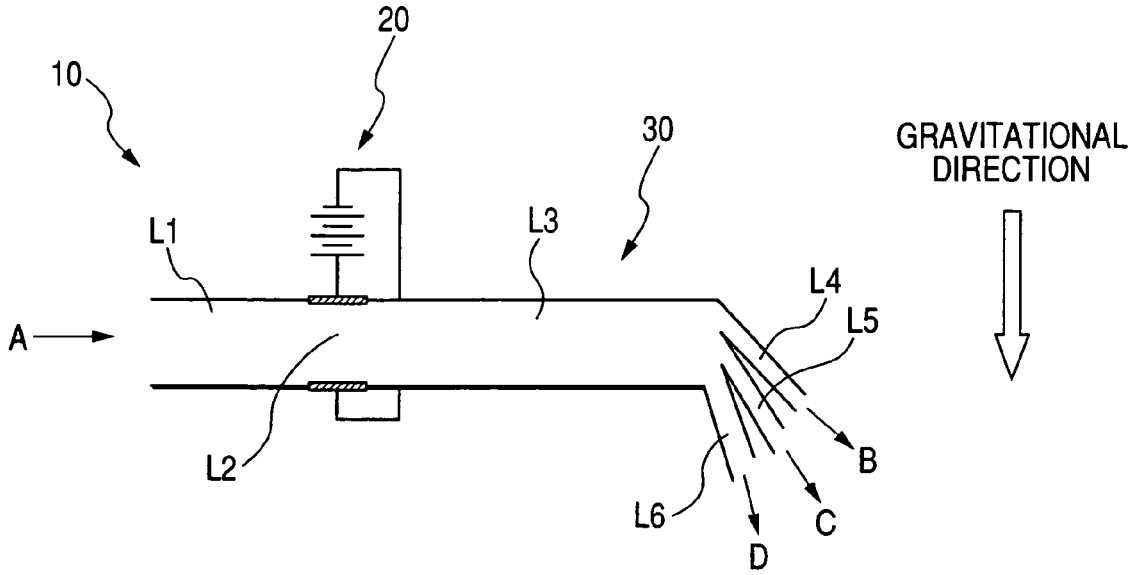
FIG. 3 is a schematic view illustrating the configuration of a fine particle classifier used in Example 1.

FIG. 3 is a schematic view illustrating a classifier used in Example 1. The classifier is a microreactor 10 that has an electric field applying part 20 and a classification part 30. An inlet passage L1, an electric field applying passage 20, and a classification flow channel L3 are disposed to extend perpendicularly to the gravitational direction, that is, are horizontally disposed. The collection passages L4 to L6 are disposed to be inclined to a horizontal direction or a gravitational direction by an angle that will be described later.

The classification of styrene-n-butyl acrylate resin fine particle dispersion (a composition ratio was 75:25, and a weight-average molecular weight was 35,000) was performed by using the aforementioned classifier. The specific gravity of the resin was 1.08. The particle diameter of the fine particles ranged from 3 μm to 18 μm. The volume-average particle diameter of the fine particles was 12 μm. The resin fine particle dispersion is a water dispersion containing 12% by volume of fine particles.

The classifier used in this Example was manufactured by an ordinarily known microreactor manufacturing method. That is, a desired groove was dug in one of acrylate plates by using an end mill. Then, this acrylate plate and another acrylate plate were put together to form a flow channel, and were heat-fused to each other by utilizing heat and pressure. At that time, it was necessary to determine the depth of the groove by taking a reduction in dimensions of the flow channel due to the heat-fusing. Subsequently, holes were formed at places, which respectively correspond to inlet and outlet ports, to connect tubes drawn from a syringe pump and the like or to attach joints a discharging tube and the like thereto. Then, the holes are tapped and are completed. The dimensions of the flow channels were described later.

Subsequently, to form the flow channels, electric field applying electrodes were formed by being gold-plated on the inner top surface and the inner bottom surface arranged in the gravitational direction of the inner wall of the electric field applying flow channel L2 before the acrylate plates were joined by heat and pressure. Also, electric field applying wires were produced by plating.

Incidentally, in the following description of the dimensions, the term "wide" corresponds to a horizontal side extending in a direction perpendicular to the direction of flow of the fine particle dispersion liquid A in the classification flow channel. The term "high" corresponds to a side perpendicular to the side corresponding to the term "wide". Further, the term "length" designates the distance between the central points of rectangles at both ends of the classification flow channel (the same holds in the following descriptions of Examples).

The inlet flow channel L1 had a cross-section that was a rectangle in shape, which was 500 μm high by 200 μm wide, and also had a length of 20 mm.

The electric field applying flow channel L2 had a cross-section that was a rectangle in shape, which was 500 μm high by 200 μm wide, and also had a length of 10 mm.

The classification flow channel L3 had a cross-section that was a rectangle in shape, which was 500 μm high by 200 μm wide, and also had a length of 150 mm.

The collection passage L4 had a joint surface that was joined with the classification flow channel L3 and was a rectangle in shape, which was 150 μm high by 200 μm wide, and also had a length of about 70 mm and was inclined to a horizontal direction by an angle of 45°.

The collection passage L5 had a joint surface that was joined with the classification flow channel L3 and was a rectangle in shape, which was 150 μm high by 200 μm wide, and also had a length of about 60 mm and was inclined to a horizontal direction by an angle of 55°.

The collection passage L6 had a joint surface that was joined with the classification flow channel L3 and was a rectangle in shape, which was 200 μm high by 200 μm wide, and also had a length of about 50 mm and was inclined to a horizontal direction by an angle of 75°.

The fine particle dispersion liquid was delivered at a rate of 2.0 ml/hr by a micro syringe to the classifier. Incidentally, in this example, the classifier did not have a fluid inlet port. The fine particle dispersion liquid was horizontally delivered by the micro syringe to the classifier.

The flow rate of the fine particle dispersion liquid in each of the flow channels L1 to L3 is adjusted to 4.3 mm/s.

In the electric field applying part, a voltage of 3V, which caused the polarity of the upper electrode to be positive, was applied, and the delivery of the liquid was continued.

Consequently, it was confirmed that the fine particles having particle diameters ranging from 3 μm to 10 μm were collected from the collection port B, that the fine particles having particle diameters ranging from 10 μm to 14 μm were collected from the collection port C, that the fine particles having particle diameters ranging from 14 μm to 18 μm were collected from the collection port D, and that thus, the fine particles were classified with food precision.

This delivery of the liquid was continued for about 5 hours. However, there were no signs of the sedimentation of the fine particles and the blocking-up of the flow channel.

Also, the classifier had no rotary mechanism. Thus, foreign substances, such wear metal pieces, did not get into the classifier. The cleaning of the classifier was easy to perform. The efficiency in collecting the fine particles was almost 100% and was very high.

COMPARATIVE EXAMPLE 1

The classification of the fine particles contained in the fine particle dispersion liquid was performed under conditions which were similar to those in the case of Example 1 except that no electric field was applied. Consequently, it was found that the fine particles having the particle diameters ranging from 3 μm to 18 μm were included in the fine particles obtained from the collection port D, and that high-accuracy classification of fine particles could not be achieved.

Example 2

Figure 4:
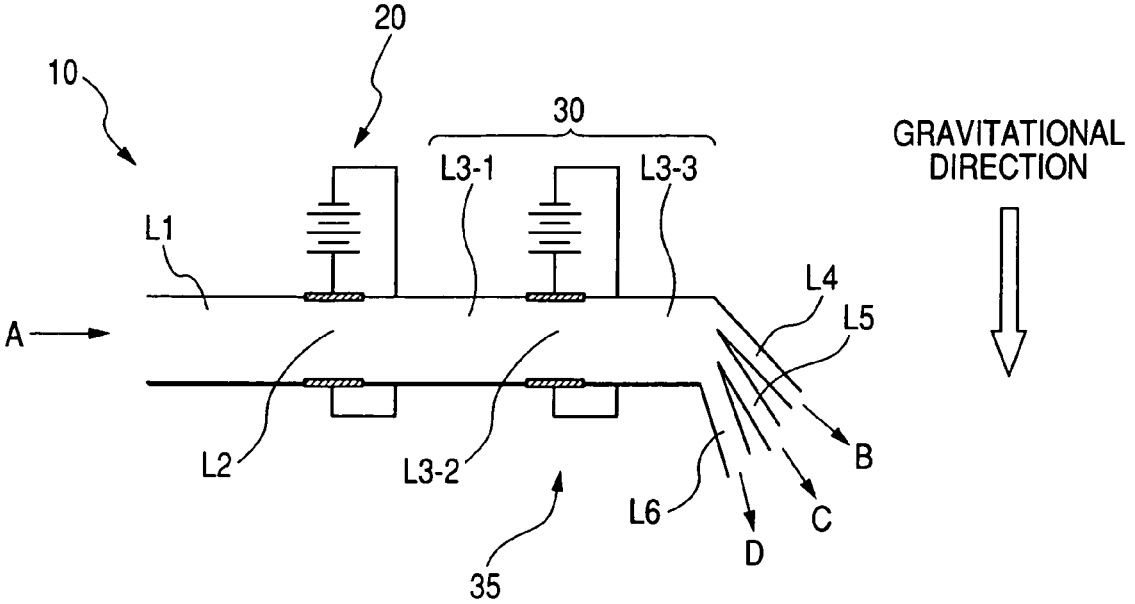
FIG. 4 is a schematic view illustrating the configuration of a fine particle classifier used in Example 2.

FIG. 4 is a schematic view illustrating a classifier used in Example 1. The classifier is a microreactor 10 that has an electric field applying part 20 and a classification part 30. Further, the classification part 30 has a second electric field applying part 35.

An inlet passage L1, an electric field applying passage L2, and classification flow channels L3-1 to L3-3 are disposed to extend perpendicularly to the gravitational direction, that is, are horizontally disposed. The collection passages L4 to L6 are disposed to be inclined to a horizontal direction or a gravitational direction by an angle that will be described later.

The classification of styrene-n-butyl acrylate resin fine particle dispersion (a composition ratio was 75:25, and a weight-average molecular weight was 35,000) was performed by using the aforementioned classifier. The specific gravity of the resin was 1.08. The particle diameter of the fine particles ranged from 3 μm to 18 μm. The volume-average particle diameter of the fine particles was 12 μm. The resin fine particle dispersion is a water dispersion containing 12% by volume of fine particles.

The classifier used in this Example was manufactured by an ordinarily known microreactor manufacturing method. That is, a desired groove was dug in one of acrylate plates by using an end mill. Then, this acrylate plate and another acrylate plate were put together to form a flow channel, and were heat-fused to each other by utilizing heat and pressure. At that time, it was necessary to determine the depth of the groove by taking a reduction in dimensions of the flow channel due to the heat-fusing. Subsequently, holes were formed at places, which respectively correspond to inlet and outlet ports, to connect tubes drawn from a syringe pump and the like or to attach joints a discharging tube and the like thereto. Then, the holes are tapped and are completed. The dimensions of the flow channels were described later.

Subsequently, to form the flow channels, electric field applying electrodes were formed by being gold-plated on the inner top surface and the inner bottom surface arranged in the gravitational direction of the inner wall of each of the electric field applying flow channel L2 and the classification flow channel L3-2 before the acrylate plates were joined by heat and pressure. Also, electric field applying wires were produced by plating.

Incidentally, in the following description of the dimensions, the term "wide" corresponds to a horizontal side extending in a direction perpendicular to the direction of flow of the fine particle dispersion liquid A in each of the classification flow channels L3-1 to L3-3. The term "high" corresponds to a side perpendicular to the side corresponding to the term "wide". Further, the term "length" designates the distance between the central points of rectangles at both ends of the classification flow channel (the same holds in the following descriptions of Examples).

The inlet flow channel L1 had a cross-section that was a rectangle in shape, which was 500 μm high by 200 μm wide, and also had a length of 20 mm.

The electric field applying flow channel L2 had a cross-section that was a rectangle in shape, which was 500 μm high by 200 μm wide, and also had a length of 10 mm.

The classification flow channel L3-1 had a cross-section that was a rectangle in shape, which was 500 μm high by 200 μm wide, and also had a length of 150 mm.

The classification flow channel L3-2 had a cross-section that was a rectangle in shape, which was 500 μm high by 200 μm wide, and also had a length of 50 mm.

The classification flow channel L3-3 had a cross-section that was a rectangle in shape, which was 500 μm high by 200 μm wide, and also had a length of 25 mm.

The collection passage L4 had a joint surface that was joined with the classification flow channel L3 and was a rectangle in shape, which was 150 μm high by 200 μm wide, and also had a length of about 70 mm and was inclined to a horizontal direction by an angle of 45°.

The collection passage L5 had a joint surface that was joined with the classification flow channel L3 and was a rectangle in shape, which was 150 μm high by 200 μm wide, and also had a length of about 60 mm and was inclined to a horizontal direction by an angle of 55°.

The collection passage L6 had a joint surface that was joined with the classification flow channel L3 and was a rectangle in shape, which was 200 μm high by 200 μm wide, and also had a length of about 50 mm and was inclined to a horizontal direction by an angle of 75°.

The fine particle dispersion liquid was delivered at a rate of 2.0 ml/hr by a micro syringe to the classifier. Incidentally, in this example, the classifier did not have a fluid inlet port. The fine particle dispersion liquid was horizontally delivered by the micro syringe to the classifier.

The flow rate of the fine particle dispersion liquid in each of the flow channels L1 to L3-3 is adjusted to 4.3 mm/s.

In the electric field applying part, a voltage of 3V, which caused the polarity of the upper electrode to be positive, was applied, and the delivery of the liquid was continued.

Also, in the second electric field applying part, a voltage of 1V, which caused the polarity of the upper electrode to be positive, was applied, and the delivering of the liquid was continued.

Consequently, it was confirmed that the fine particles having particle diameters ranging from 3 μm to 10 μm were collected from the collection port B, that the fine particles having particle diameters ranging from 10 μm to 14 μm were collected from the collection port C, that the fine particles having particle diameters ranging from 14 μm to 18 μm were collected from the collection port D, and that thus, the fine particles were classified with food precision. Especially, when the particle size distribution of the fine particles was carefully checked, it was found that the collected fine particles of each particle-size class were almost not mixed with the fine particles of a just higher particle-size class and a just lower particle-size class, and that the particle-size classes of the collected fine particles were very sharply distinguished from one another.

This delivery of the liquid was continued for about 5 hours. However, there were no signs of the sedimentation of the fine particles and the blocking-up of the flow channel.

Also, the classifier had no rolling mechanism. Thus, foreign substances, such wear metal pieces, did not get into the classifier. The cleaning of the classifier was easy to perform. The efficiency in collecting the fine particles was almost 100% and was very high.

The entire disclosure of Japanese Patent Application 2005-339574 filed on Nov. 25, 2005 including specification, claims, drawings and abstract is incorporated herein by reference in its entirely.

What is claimed is:

1. A method of classifying fine particles, comprising:

introducing a fine particle dispersion containing the fine particles to a micro flow channel having an inlet part and a collection part from the inlet part;

moving all of the fine particles to an inner upper side of the micro flow channel by an electric field applied in a gravitational direction; and delivering the fine particle dispersion in a laminar flow state to the collection part;

wherein the delivering step includes classifying the fine particles according to differences in settling velocity among the fine particles.

2. The method of classifying fine particles according to claim 1, wherein the fine particles are selected from the group consisting of resin fine particles, inorganic fine particles, metal fine particles and ceramic fine particles.

3. The method of classifying fine particles according to claim 1, wherein a volume-average diameter of the fine particles is ranged from 0.1 μm to 1000 μm.

4. The method of classifying fine particles according to claim 1, wherein a rate of content of the fine particles in the fine-particle dispersion is ranged from 0.1-40% by volume.

5. The method of classifying fine particles according to claim 1, wherein the classifying step includes applying a second electric field that increases differences in settling velocity among the fine particles according to sizes of the fine particles.

6. The method of classifying fine particles according to claim 1, wherein an absolute value of ζ potential of the fine particles ranges from 1 mV to 1,000mV.

7. The method of classifying fine particles according to claim 1, wherein a magnitude of the electric field applied in a gravitational direction applied to the electrodes ranges from 0.1V to 5V.

8. The method of classifying fine particles according to claim 5, wherein a magnitude of the electric field that increases the differences in the settling velocity among the fine particles ranges from 0.1V to 5V.

9. An apparatus of classifying fine particles dispersed in a medium liquid in a fine-particle dispersion, comprising:

an introducing part including an introducing channel that introduces the fine-particle dispersion into a micro flow channel;

an electric field applying part that applies an electric field in a gravitational direction that moves all of the fine particles to an inner upper side of the micro flow channel;

a classification part that classifies the fine particles by settling or floating the fine particles in a laminar flow; and a collection part including a collection channel from which classified fine particles are collected.

10. The apparatus according to claim 9, wherein the collection channel includes a plurality of collection channels.

11. The apparatus according to claim 10, wherein the plurality of collection channels are respectively disposed at different heights in a gravitational direction.

12. The apparatus according to claim 9, wherein the classification part includes a second electric field applying part.

13. The apparatus according to claim 9, wherein the introducing channel and the collection channel are disposed at 0 to 45° to a gravitational direction.

* * * * *